US010107067B2

(12) United States Patent
Hansen et al.

(10) Patent No.: US 10,107,067 B2
(45) Date of Patent: Oct. 23, 2018

(54) METHODS FOR PLACING A BARRIER MATERIAL IN A WELLBORE TO PERMANENTLY LEAVE TUBING IN CASING FOR PERMANENT WELLBORE ABANDONMENT

(71) Applicant: Aarbakke Innovation, A.S., Bryne (NO)

(72) Inventors: Henning Hansen, Dolores (ES); Tarald Gudmestad, Nærbø (NO)

(73) Assignee: AARBAKKE INNOVATION, A.S., Bryne (NO)

( * ) Notice: Subject to any disclaimer, the term of this patent is extended or adjusted under 35 U.S.C. 154(b) by 141 days.

(21) Appl. No.: 15/262,109

(22) Filed: Sep. 12, 2016

(65) Prior Publication Data

US 2017/0081943 A1 Mar. 23, 2017

Related U.S. Application Data

(60) Provisional application No. 62/221,643, filed on Sep. 22, 2015.

(51) Int. Cl.
*E21B 33/13* (2006.01)

(52) U.S. Cl.
CPC ..... *E21B 33/13* (2013.01)

(58) Field of Classification Search
CPC ..... E21B 33/13; E21B 33/146
See application file for complete search history.

(56) References Cited

U.S. PATENT DOCUMENTS

| | | | | | |
|---|---|---|---|---|---|
| RE19,570 | E | * | 5/1935 | Halliburton | E21B 33/146 166/289 |
| 2,249,511 | A | * | 7/1941 | Westall | E21B 33/146 166/154 |
| 2,368,419 | A | * | 1/1945 | McGivern | E21B 33/146 137/67 |
| 3,768,562 | A | * | 10/1973 | Baker | E21B 33/146 166/289 |
| 4,105,069 | A | | 8/1978 | Baker | |
| 5,884,702 | A | * | 3/1999 | Yokley | E21B 23/04 166/285 |
| 5,960,881 | A | * | 10/1999 | Allamon | E21B 21/103 166/285 |
| 6,085,838 | A | * | 7/2000 | Vercaemer | E21B 43/105 166/177.4 |
| 2002/0174992 | A1 | * | 11/2002 | Dewey | E21B 23/01 166/382 |

(Continued)

OTHER PUBLICATIONS

International Search Report, International Application No. PCT/NO2016/050188.

(Continued)

*Primary Examiner* — Shane Bomar
(74) *Attorney, Agent, or Firm* — Richard A. Fagin

(57) ABSTRACT

Methods for sealing a wellbore include placing a barrier material within an annular space between a wellbore tubing and a wellbore casing, wherein a seal is placed across or below openings in the wellbore tubing at at least one location above a lowermost tubing to annulus opening. In some embodiments, an intervention tubing may be used to insert the barrier material into successively exposed ones of the annulus openings, whereby no seal sleeve is needed.

13 Claims, 11 Drawing Sheets

(56) References Cited

U.S. PATENT DOCUMENTS

| | | | | |
|---|---|---|---|---|
| 2009/0071644 | A1* | 3/2009 | Themig | E21B 33/12 166/188 |
| 2012/0261127 | A1 | 10/2012 | Zhou | |
| 2013/0269948 | A1 | 10/2013 | Hoffman | |
| 2015/0060063 | A1 | 3/2015 | Miller | |
| 2016/0024896 | A1* | 1/2016 | Johnson | E21B 33/1208 166/302 |

OTHER PUBLICATIONS

Written Opinion of the International Search Authority, International Application No. PCT/NO2016/050188.

* cited by examiner

METHODS FOR PLACING A BARRIER MATERIAL IN A WELLBORE TO PERMANENTLY LEAVE TUBING IN CASING FOR PERMANENT WELLBORE ABANDONMENT

CROSS REFERENCE TO RELATED APPLICATIONS

Priority is claimed from U.S. Provisional Application No. 62/221,643 filed on Sep. 22, 2015 and incorporated herein by reference in its entirety.

STATEMENT REGARDING FEDERALLY SPONSORED RESEARCH OF DEVELOPMENT

Not Applicable.

NAMES TO THE PARTIES TO A JOINT RESEARCH AGREEMENT

Not Applicable.

BACKGROUND

This disclosure relates to subterranean oil and gas wells. More specifically, the disclosure relates to plugging and abandonment of such wells.

Plugging and abandonment of oil and gas production related wellbores can be quite expensive, particularly for subsea wells. Typically, a drilling rig or other type of rig needs to be mobilized and used to place required barriers in the wellbore, as well as to pull tubulars such as velocity tubing strings from the wellbore so that the barriers can be placed and tested.

If production or injection tubing can be permanently left in a wellbore, the time consuming and expensive operation of pulling the tubing out of the wellbore can be avoided. However, the external volume between the tubing and the casing as well as the internal volume of the tubing must be sealed off with a barrier capable of maintaining permanent safety of the wellbore against any possible fluid leakages.

Technologies exist to penetrate a production or injection tubing, where the penetration can be performed by an explosive charge, by a mechanical punch, by a drilling tool and the like. International Application Publication No. WO 2015/175025 entitled, "Multifunction wellbore tubular penetration tool", describes a tool that can penetrate tubing, remove "window" sections in a tubing as well as cut and remove so called micro tubes (cables, control lines, and similar) that are mounted externally on the tubing string. These openings may be performed at a plurality of different depths in the wellbore. The micro tube removal is performed to eliminate a possible leak path such micro tubes may create, so that a barrier material can be placed between the tubing and casing with minimum risk of leakages.

SUMMARY

A method for sealing a wellbore according to one aspect of the present disclosure includes closing to fluid flow from within a wellbore tubing a plurality of longitudinally spaced apart openings in the wellbore tubing. The wellbore tubing is disposed within a wellbore casing or within a wellbore liner. The plurality of longitudinally spaced apart openings enable fluid communication with an annular space between the wellbore tubing and the wellbore casing or wellbore liner. The closing is performed on all the plurality of openings above a lowermost one of the plurality of openings. A barrier material is placed in the wellbore tubing and is displaced through the lowermost opening into the annular space to a level below a first one of the plurality of openings above the lowermost opening. The first one of the plurality of openings above the lowermost opening is exposed to fluid flow. The exposing includes maintaining closure of all of the plurality of openings above the first exposed opening. A barrier material is placed in the wellbore tubing and is displaced through the first exposed opening into the annular space.

One example embodiment includes placing a sealing sleeve in a wellbore tubing disposed within a wellbore casing or within a wellbore liner. The wellbore tubing has a plurality of longitudinally spaced apart openings in fluid communication with an annular space between the wellbore tubing and the wellbore casing or wellbore liner. The sealing sleeve covers the openings above a lowermost one of the plurality of openings. A barrier material is placed in the wellbore tubing and is displaced through the lowermost opening into the annular space to a level below one of the plurality of openings above the lowermost opening.

A barrier material is placed in the wellbore tubing and is displaced through the first exposed opening into the annular space.

Another example embodiment includes inserting an intervention tubing into a wellbore tubing disposed within a wellbore casing or within a wellbore liner. The wellbore tubing has a plurality of longitudinally spaced apart openings in fluid communication with an annular space between the wellbore tubing and the wellbore casing or wellbore liner. The wellbore tubing has a sealing plug in its interior proximate the wellbore tubing bottom end. A longitudinal end of the intervention tubing disposed in the wellbore tubing is sealed. A seal is actuated to hydraulically close an annular space between the intervention tubing and the wellbore tubing at a position above a lowermost one of the plurality of openings. A barrier material is placed into the intervention tubing and is displaced through the lowermost opening and into the annular space between the wellbore tubing and the wellbore casing or wellbore liner.

In some embodiments, a volume of the barrier material is selected such that a level of the barrier material completely displaced into the annular space between the wellbore tubing and the wellbore casing or wellbore liner is below a first one of the plurality of openings above the lowermost opening.

DETAILED DESCRIPTION

The present disclosure includes two example methods whereby a tubing string can be permanently sealed within a casing string, where one or several tubing-to-casing annulus (annular space between the tubing and a well casing—"annulus") openings have been made. The present disclosure also explains how a pressure response can be obtained at surface that may be used to verify barrier material displacement into the annulus.

It should be understood that the methods herein described are may be used in connection with various barrier (plugging) materials, for example and without limitation, cement, resins, epoxy, combinations of the foregoing as well as other fluid based plugging materials.

The present disclosure sets forth that one or a combination of several plugging or "barrier" materials can be pumped through a tubing that is to be sealed off from a wellhead, or via a jointed or spooled intervention tubing deployed into a tubing string already deployed in the wellbore. The present disclosure also sets forth how barrier material may be placed in stages until a required barrier length has been obtained if an intervention tubing is utilized, as well as how a full length barrier can be placed if barrier material is pumped in through the existing wellbore tubing to be sealed in the wellbore.

In various embodiments of a well sealing method according to the present disclosure, the barrier material is introduced into the wellbore tubing from a longitudinal position above the portion of the wellbore tubing and wellbore casing or liner to be sealed.

Figure 1:
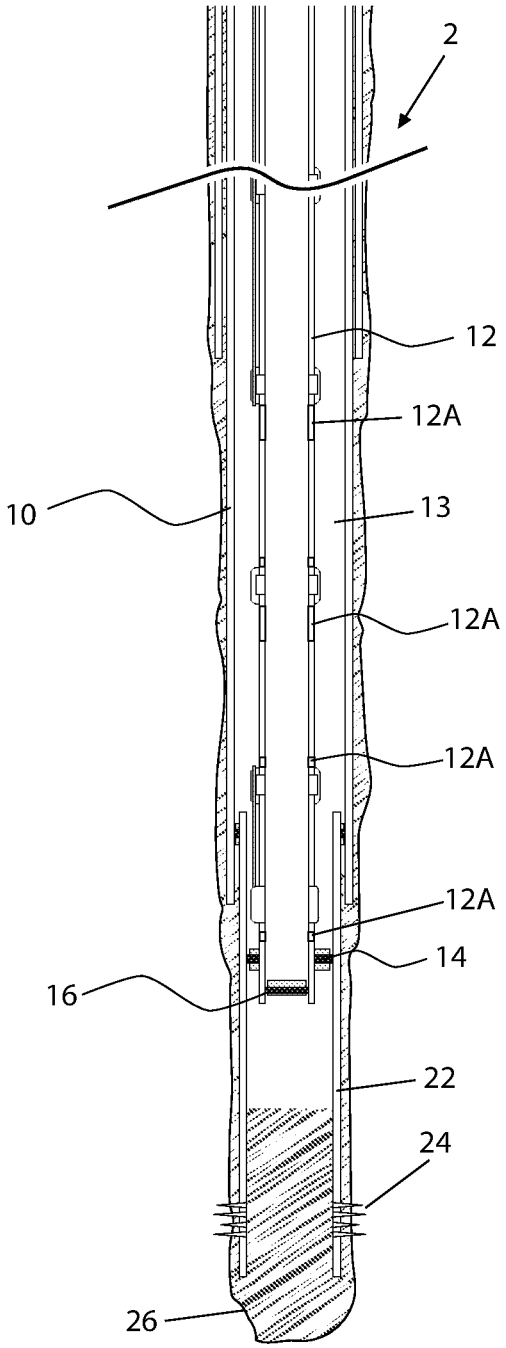
FIG. 1 illustrates a tubing string within a production casing, where several openings and micro tube removal have been performed.

FIG. 1 illustrates a fluid production or fluid injection tubing string 12 (wellbore tubing) disposed within a wellbore casing 10 in a subsurface wellbore 2, where several openings 12A of the tubing have been made. If there were micro tubes external to the wellbore tubing 12, such tubes may have been already removed. A sealing plug 16 may be placed in the lower section of the wellbore tubing 12 in addition to a barrier material 26, described further below. The barrier material 26 may be, for example cement, and has been placed deeper in the wellbore to seal off a perforated section 24 of the casing, usually adjacent a hydrocarbon bearing reservoir or a fluid injection formation, against possible fluid leaks into the casing 10 that may flow toward the surface end of the wellbore 2. In the present example embodiment, the perforated section 24 may be through an additional wellbore pipe called a liner 22. The term "liner" is generally used to describe a pipe or conduit disposed in a subsurface wellbore that extends to the bottom of the wellbore and has an upper end sealingly engaged to and above the bottom of the well casing 10, i.e., the well is drilled below the bottom of the lowermost "string" of wellbore casing, and such portion of the wellbore is encased by the liner. In other embodiments, the liner 22 may be omitted and the wellbore casing 10 may extend from a wellhead (not shown) at the surface to the bottom of the wellbore 2 and may comprise the perforated section 24. In the present example embodiment, a packer 14 may seal annular space ("annulus") 13 between the exterior of the wellbore tubing 12 and the interior of the casing 10 at a position proximate the bottom end of the wellbore tubing 12. A sealing plug 16 may be set inside and proximate the bottom of the wellbore tubing 12, or in other embodiments at least below the longitudinal position along the wellbore tubing 12 of a lowermost one of a plurality of openings 12A in the wellbore tubing 12. For purposes of defining the scope of the present disclosure, a wellbore may include either a casing and/or a liner.

Figure 2:
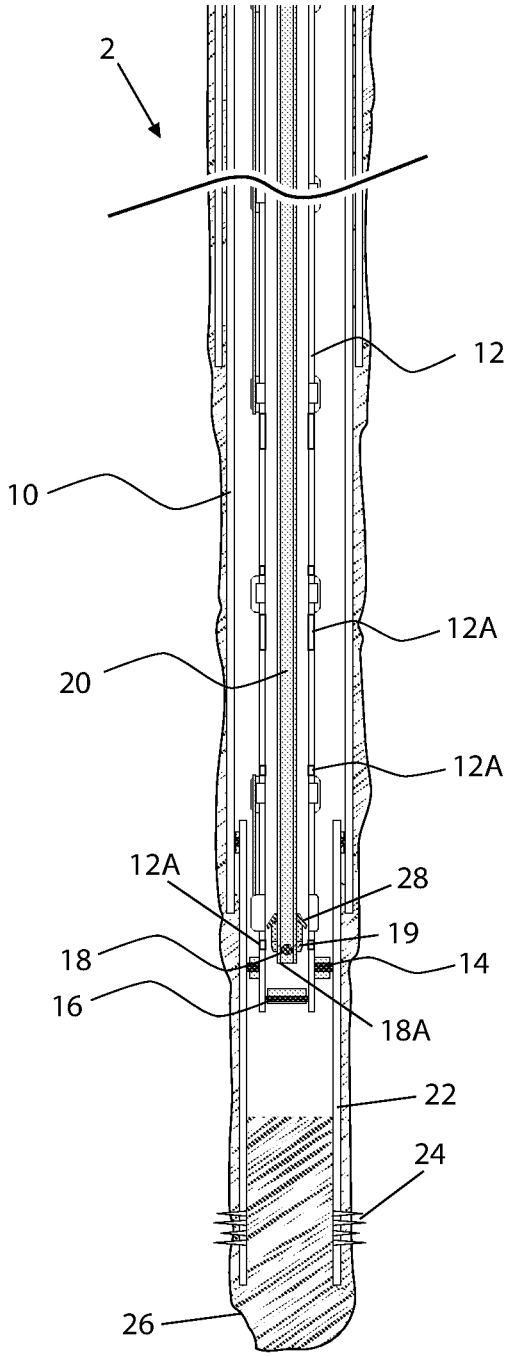
FIG. 2 illustrates an intervention tubing, spooled or jointed type, that has been inserted into an existing tubing (i.e., the production or injection tubing), where a ball or dart activates a semi flexible sealing device located in the lower end of the intervention tubing.

FIG. 2 illustrates that an intervention tubing 20, which may be a spooled (i.e., coiled tubing) or a jointed tubing, e.g., thread connected sectioned tubing, has been inserted into the wellbore tubing 12 to a level above the plug 16. A drop ball or drop dart 18 introduced into the intervention tubing and allowed to move to a ball or dart seat 18A hydraulically closes the end of the intervention tubing 20 to enable activating a semi-flexible sealing device 28 located on the outside of the lower end of the intervention tubing 20. Activation of the sealing device 28 may be performed by applying fluid pressure to the interior of the intervention tubing 20, which because such pressure is prevented from leaving the end of the intervention tubing 20 by the drop ball or dart 18 is constrained to flow through seal activation ports 18A in the intervention tubing 20 above the level of the drop ball or dart 18. The sealing device 28 may be deployed into the wellbore 2 in a laterally (diametric) retracted or collapsed configuration, as this will assist deploying the intervention tubing 20 to a selected depth in the wellbore 2 (i.e., in the wellbore tubing 12) as well as reducing the possibility of any hang-up or other impediment to movement of the sealing device 28 when passing through restrictions within the wellbore tubing 12.

Figure 3:
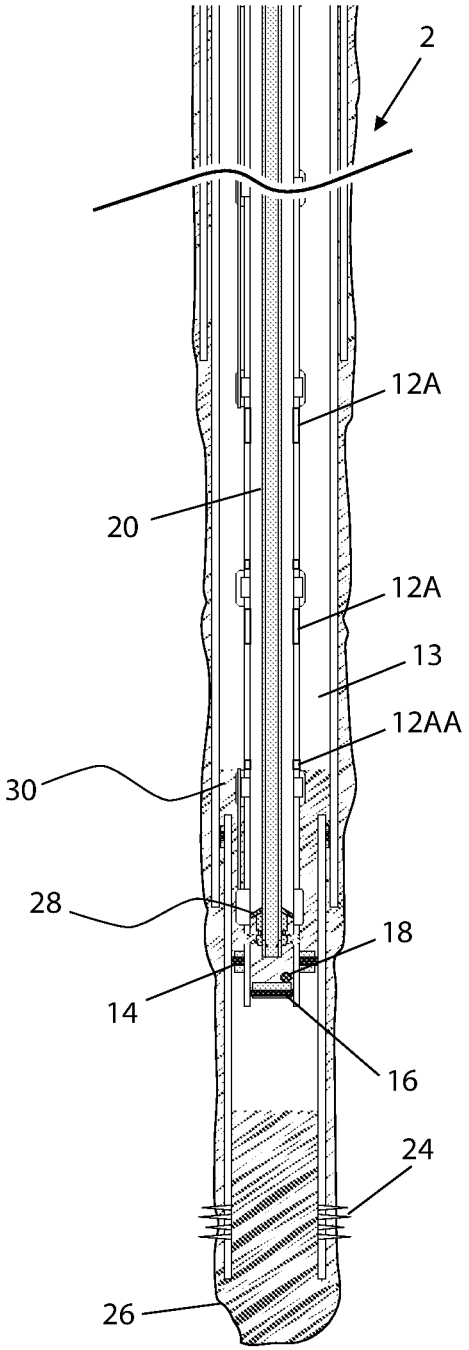
FIG. 3 illustrates that a ball or dart has been pumped out of the intervention tubing, where the ball or dart activated the expansion of a sealing cup between the intervention tubing and the production/injection tubing. Fluids and/or a sealing material has thereafter been pumped out of the lower end of the intervention tubing into the annular space between the production/injection tubing and the casing string as well as into the production/injection tubing.

After the sealing device 28 is activated, a barrier material 30, e.g., cement may be pumped into the intervention tubing 20. A second dart (see FIG. 11) may be used above the top of a column of the barrier material 30 in the intervention tubing 20 to urge the column of barrier material 30 through the intervention tubing 20, through the ports 19 and then through the openings 12A in the wellbore tubing 12 that are exposed below the ports 19 in the intervention tubing 20. The second dart (FIG. 11) further provides the function of minimizing unwanted mixing of the barrier material 30 with other fluids that may be present in the wellbore 2 and the wellbore tubing 12. Following pumping the barrier material 30 and allowing it to cure, the dart 18 may be discharged out of the lower end of the intervention tubing 20, for example by increasing fluid pressure inside the intervention tubing 20. The discharged drop ball or dart 18 may be allowed to remain in the wellbore, e.g., resting on the plug 16 as shown in FIG. 3. In some embodiments, a volume of the barrier material 30 is selected such that a level of the barrier material 30 displaced into the annular space 13 between the wellbore tubing 12 and the wellbore casing or wellbore liner 10 is below a first one of the plurality of openings 12A above the lowermost opening 12A when the barrier material is completely displaced from the intervention tubing.

FIG. 3 illustrates that the ball or dart 18 has been discharged out of the intervention tubing 20, where the ball or dart previously activated the expansion of the sealing device 28 disposed between the intervention tubing 20 and the wellbore tubing 12. Following discharge of the ball or dart 18, barrier material 30 may be pumped through and out of the bottom of the intervention tubing 20 to the area within the wellbore tubing 12 where the barrier material 30 also will exit through the opening(s) 12A located below the sealing device 28. Sufficient barrier material 30 may be pumped to form a barrier up to just below the level of the first tubing opening 12AA located above the sealing device 28.

Figure 4:
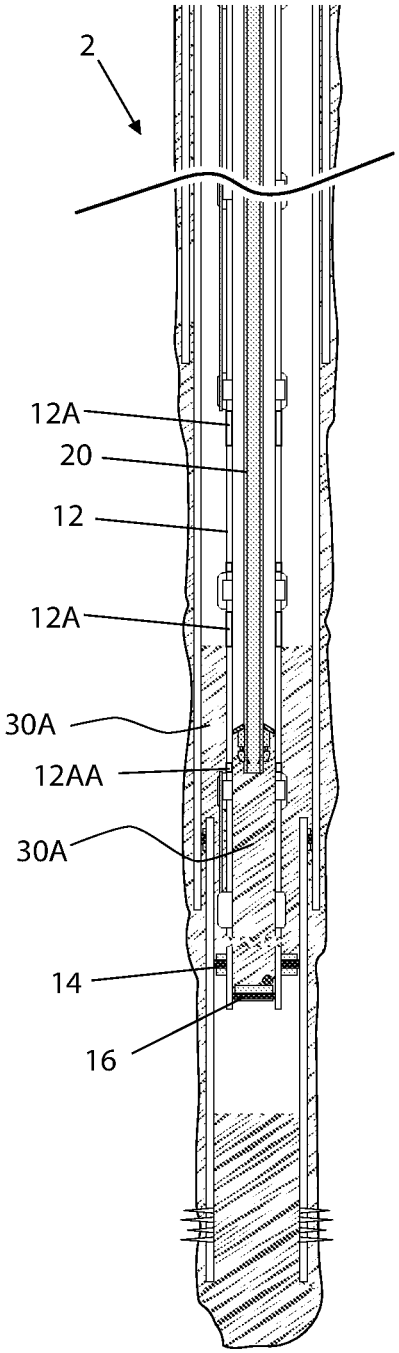
FIG. 4 illustrates that the intervention tubing has been pulled up in the wellbore, followed by placement of barrier material above the section filled in the previous operation.

FIG. 4 illustrates that the intervention tubing 20 has been pulled upwardly in the wellbore tubing 12, followed by placement of barrier material 30A above the wellbore section filled with barrier material as described with reference to the previous operation and with reference to FIG. 2 and FIG. 3. An example embodiment of a process to obtain a required barrier material 30A length within the wellbore tubing 12 as well as in the annulus 13 between the wellbore tubing 12 and the casing or liner 10 is to repeat the foregoing operation as will be further described with reference to FIGS. 5 and 6.

Figure 5:
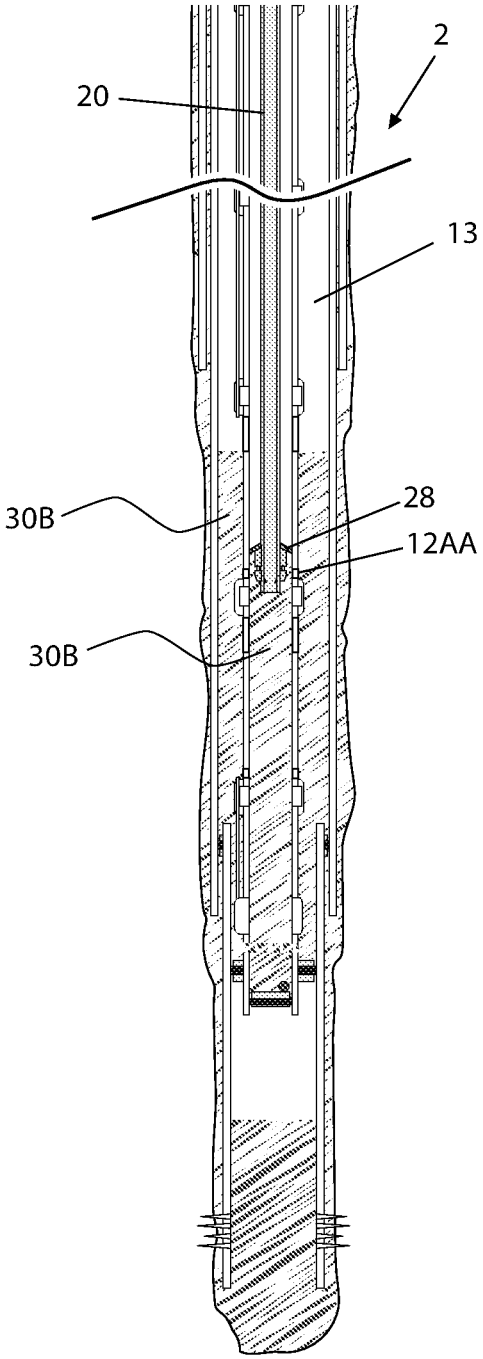
FIG. 5 illustrates the operation as described with reference to FIG. 4, further up in the wellbore.

FIG. 5 illustrates the operation as described with reference to FIG. 4, conducted further up in the wellbore tubing 12, wherein the intervention tubing 20 is moved upwardly in the wellbore tubing 12.

Figure 6:
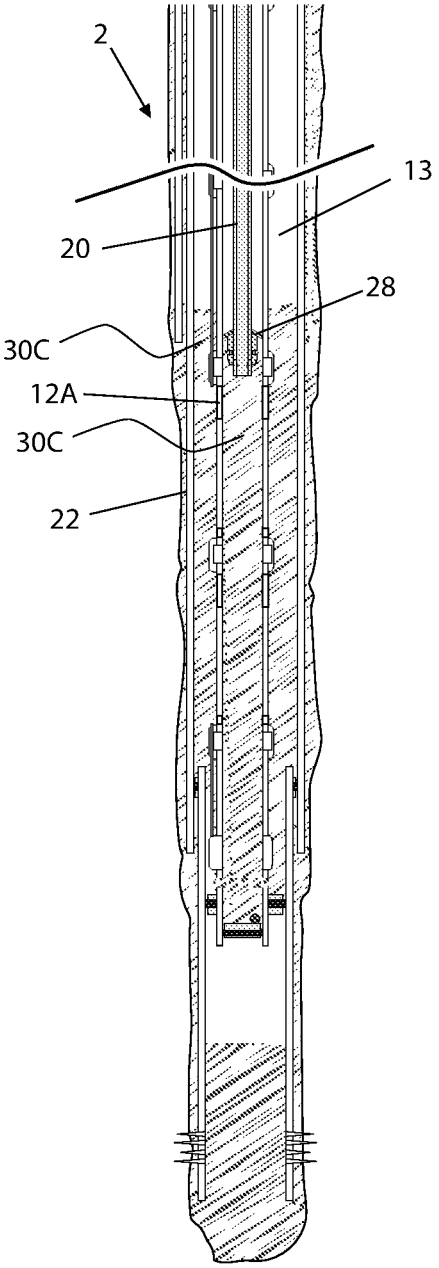
FIG. 6 illustrates placing the barrier material having been repeated until a required barrier length has been obtained.

FIG. 6 illustrates that the operation of moving the intervention tubing 20 and placing the barrier material 30C has been repeated until a selected length of barrier material 30C has been obtained within the wellbore tubing 12 and in the annular space 13.

Figure 7:
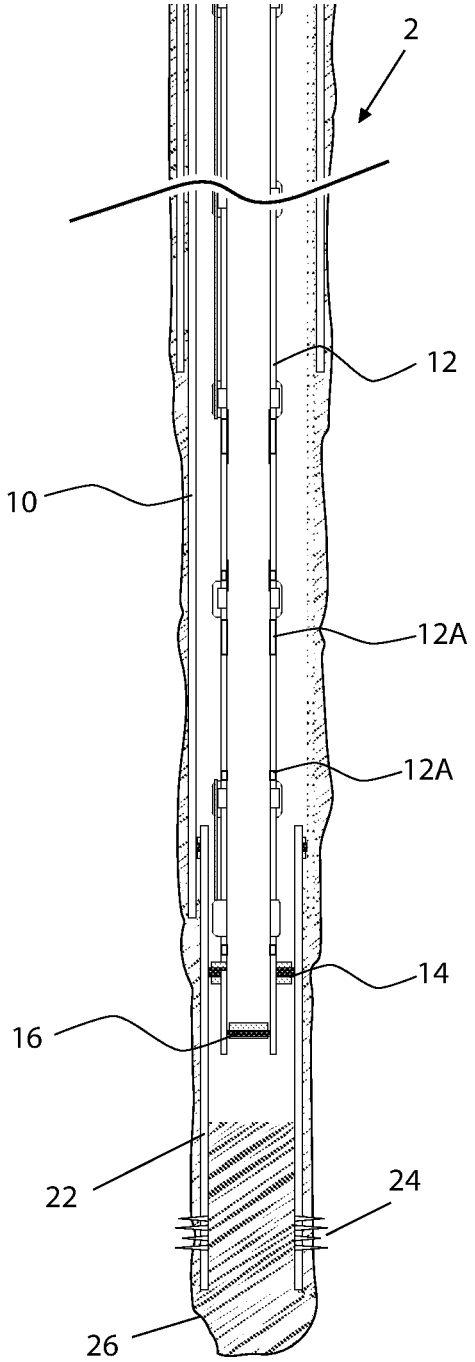
FIG. 7 illustrates a production/injection tubing string within a production casing, where several openings through the tubing to the tubing/casing annulus have been created. A plug has been placed in the lower section of the production/injection tubing string. A barrier material has been placed below, to seal off a section of the casing.

FIG. 7 illustrates another example embodiment wherein a wellbore tubing 12 is disposed within a wellbore casing 10, where several longitudinally spaced apart openings 12A through the wellbore tubing 12 to the tubing/casing annulus 13 have been formed. A plug 16 has been placed in the lower section of the wellbore tubing 12. A barrier material 26 has been placed below the plug 16, to seal off, e.g., a perforated part 24 of the wellbore casing (e.g., adjacent a reservoir formation or injection formation), or, as in the present example embodiment, of a liner 22.

Figure 8:
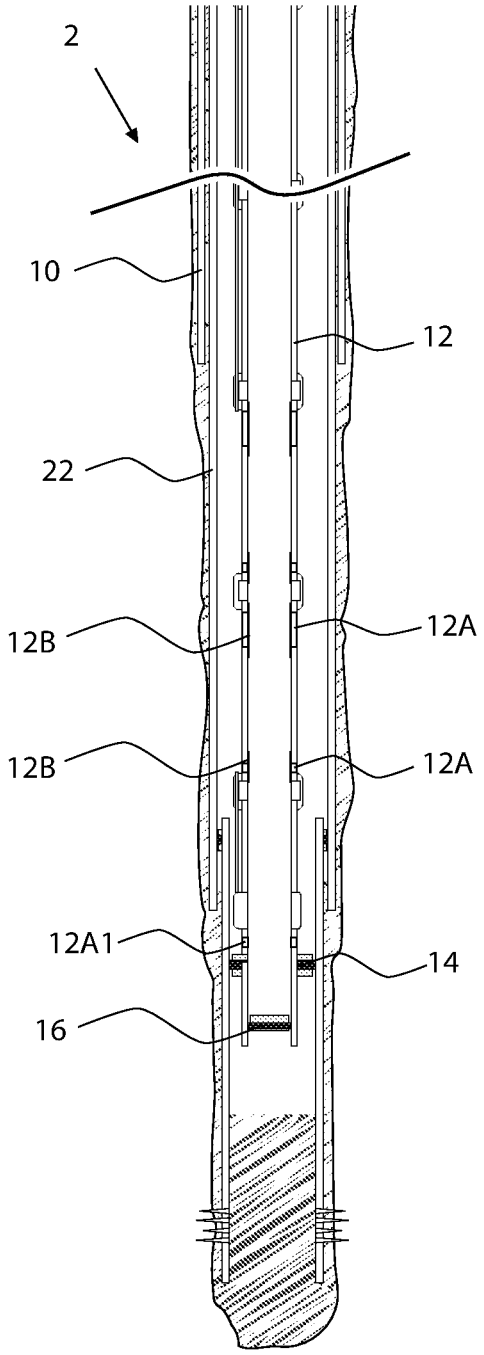
FIG. 8 illustrates that sleeves (hollow cylinders) have been installed by for example wireline technique within the areas of the tubing that has been penetrated, except for the lowest opening that is here illustrated immediately above the production packer.

FIG. 8 illustrates that a seal sleeve 12B (e.g., in the form of hollow or annular cylinders) has been installed, for example, by extending it on the end of an armored cable (wireline or slickline), or by using the intervention tubing (20 in FIG. 2) to a position within the areas of the tubing 12 that have been penetrated, e.g., at 12A, except for the lowermost opening 12AA that is herein illustrated immediately above the packer 14. Such sleeves are available from a number of suppliers, and are often referred to as "separation sleeves", "patches", etc. Also there are expandable tubes for use in wellbore work, where such tubes can be laterally expanded and anchored in a wellbore or a wellbore conduit using hydraulic or mechanical energy for such lateral expansion. The seal sleeve 12B for the present example methods does not need to be pressure tight, and does not need to withstand a large differential pressure; it is only necessary for the seal sleeve 12B to be able to prevent a substantial cross flow of the barrier material (e.g., cement 30 in FIG. 3) during the barrier material placement operation. Hence, seal sleeves made of metal as well as composite or plastic materials may be used in various embodiments.

Figure 9:
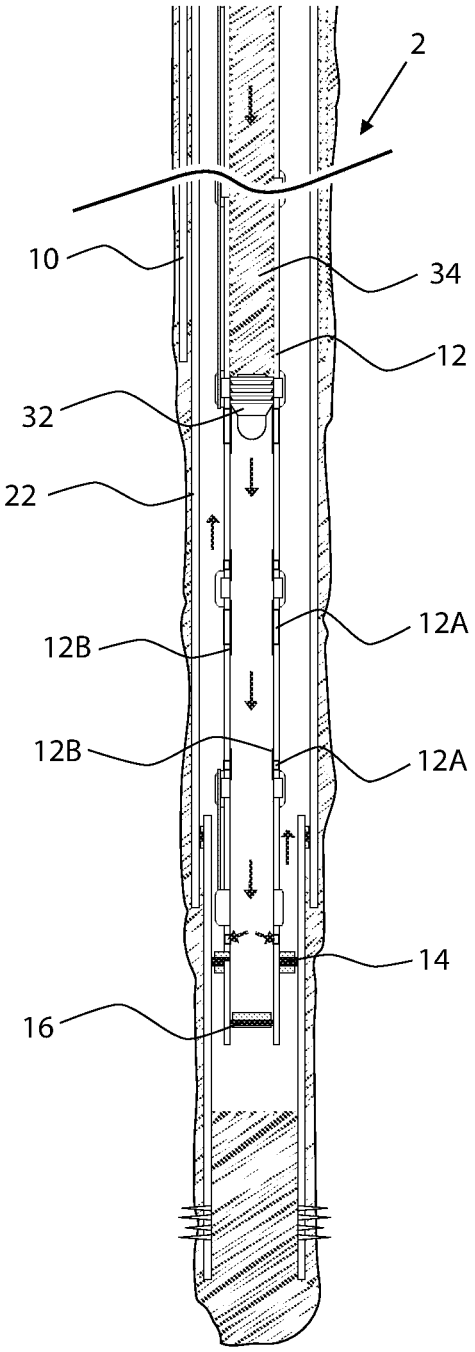
FIG. 9 illustrates that a dart is pumped into the wellbore from the wellhead area, where this dart is followed by a barrier material as for example cement.

FIG. 9 illustrates that a dart 32 may be pumped into the wellbore from proximate the wellhead (not shown), where the dart 32 may be followed by a pumping a barrier material 34, as for example cement. Fluids already present in the wellbore are displaced in front of the dart 32 into the annulus 13 through the lowest opening 12A1 in the tubing 12. Fluid in the annulus 13 would typically be returned to a surface tank system coupled by hoses or similar to a wellhead annulus outlet valve (e.g., a casing valve on the wellhead).

Figure 10:
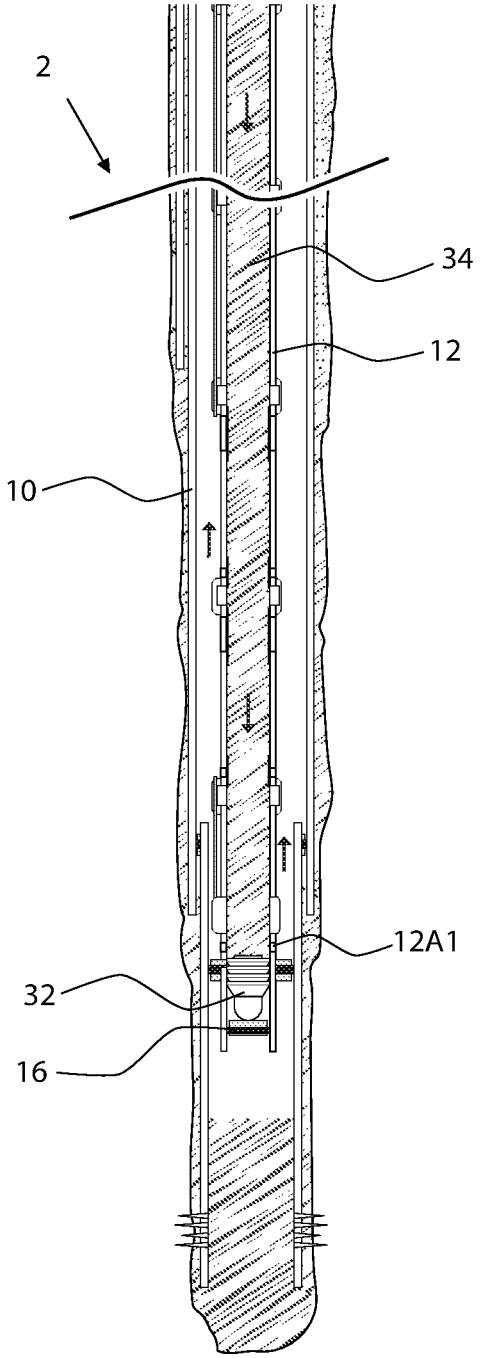
FIG. 10 illustrates that the dart has landed below the lowest tubing-to-annulus opening, where now the barrier material can be pumped through same opening into the annulus.

FIG. 10 illustrates that the dart 32 has landed below the lowest wellbore tubing to annulus opening 12A1, where now the barrier material 34 can be pumped through the same opening 12A1 into the annulus 13.

Figure 11:
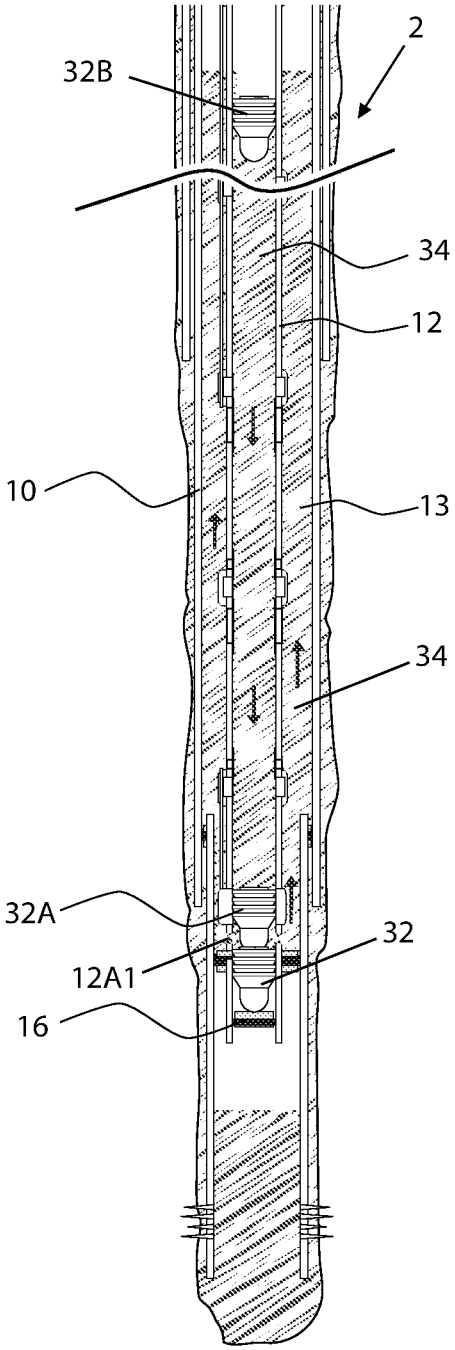
FIG. 11 illustrates that a second dart has been pumped in behind volume of barrier material required to seal off to required height in the annulus, as well as a third dart placed behind a predetermined volume of cement required to establish a required height plug within the production/injection tubing.

FIG. 11 illustrates that a second dart 32A has been pumped in behind the volume of barrier material 34 required to seal off the desired height in the annulus 13, as well as a third dart 32B placed behind a predetermined volume of barrier material 34 (e.g., cement) required to establish a required length barrier within the tubing 12. When the second dart 32A lands in the wellbore tubing 12, it prevents further barrier material 34 from exiting through the lowermost wellbore tubing opening 12A1, causing a pressure increase to be observed at surface. Now a predetermined length of barrier material 34 has been placed within as well as externally of the tubing 12. The foregoing operations may enable sealing the well 2 without the need to remove the tubing 12 and its associated cost and risk. In some embodiments, a volume of the barrier material 30 is selected such that a level of the barrier material 34 displaced into the annular space 13 between the wellbore tubing 12 and the wellbore casing or wellbore liner 10 is below a first one of the plurality of openings 12A above the lowermost opening 12A1 when the barrier material 34 is completely displaced from the interior of the wellbore tubing 12.

In the above described embodiments, the openings 12A, 12AA in the wellbore tubing 12 may be made using an apparatus and method described in International Patent Application Publication No. WO 2015/175025. A possible advantage of using such apparatus and method is that it may be possible to reduce the risk of penetrating the casing or liner as would be the case if other penetration techniques such as explosive shaped charge perforation were used.

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

What is claimed is:

1. A method for sealing a wellbore, comprising:

closing to fluid flow from within a wellbore tubing a plurality of longitudinally spaced apart openings in the wellbore tubing, the wellbore tubing disposed within a wellbore casing or within a wellbore liner, the plurality of longitudinally spaced apart openings in fluid communication with an annular space between the wellbore tubing and the wellbore casing or wellbore liner, the closing performed on all the plurality of openings above a lowermost one of the plurality of openings wherein the closing to fluid flow comprises;

inserting an intervention tubing into the wellbore tubing, the wellbore tubing comprising a sealing plug in its interior proximate a bottom end of the wellbore tubing, sealing a longitudinal end of the intervention tubing disposed in the wellbore tubing, actuating a seal to hydraulically close an annular space between the intervention tubing and the wellbore tubing at a position above the lowermost one of the plurality of openings and placing the barrier material into the intervention tubing and displacing the barrier material through the lowermost opening and into the annular space between the wellbore tubing and the wellbore casing or wellbore liner, placing a barrier material in the wellbore tubing and displacing the barrier material through the lowermost opening into the annular space to a level below a first one of the plurality of openings above the lowermost opening;

exposing to fluid flow the first opening above the lowermost opening, the exposing comprising maintaining closure of all of the plurality of openings above the first exposed opening; and placing a barrier material in the wellbore tubing and displacing the barrier material through the first exposed opening into the annular space.

2. The method of claim 1 wherein the barrier material comprises at least one of cement, resin, epoxy and combinations thereof.

3. The method of claim 1 further comprising exposing a second one of the plurality of openings above the first exposed opening, the exposing the second opening comprising maintaining closure of all the plurality of openings above the second exposed opening, placing a barrier material in the wellbore tubing and displacing the barrier material through the second exposed opening into the annular space to a level below one of the plurality of openings above the second opening.

4. The method of claim 1 wherein the closing to fluid flow comprises inserting at least one sealing sleeve into contact with an interior surface of the wellbore tubing.

5. The method of claim 1 wherein the wellbore tubing comprises a plug disposed at a selected position below the lowermost opening.

6. The method of claim 1 wherein a volume of the barrier material is selected such that a level of the barrier material displaced into the annular space between the wellbore tubing and the wellbore casing or wellbore liner is below the first exposed opening.

7. The method of claim 1 wherein a volume of the barrier material is selected such that a level of the barrier material displaced into the annular space between the wellbore tubing and the wellbore casing or wellbore liner is below the first exposed opening.

8. The method of claim 1 wherein the sealing the longitudinal end of the intervention tubing comprises dropping a sealing ball or sealing dart into the intervention tubing to cause the sealing ball or sealing dart to close the longitudinal end of the intervention tubing.

9. The method of claim 8 wherein the actuating the seal comprises pumping fluid into the intervention tubing to expand a seal element disposed on an exterior of the intervention tubing.

10. The method of claim 9 further comprising discharging the sealing dart or sealing ball after expanding the seal and prior to placing the barrier material by pumping fluid into the intervention tubing.

11. The method of claim 1 further comprising inserting a displacement dart into the intervention tubing following insertion of the barrier material into the intervention tubing and pumping fluid into the intervention tubing to move the displacement dart along the intervention tubing until the displacement dart exposes the sealing material for the lowermost opening.

12. The method of claim 1 further comprising:

lifting the intervention tubing to a position in the wellbore tubing such that the seal is disposed above the first exposed opening;

repeating sealing the longitudinal end of the intervention tubing disposed in the wellbore tubing; and repeating placing a barrier material into the intervention tubing and displacing the barrier material through the first one of the plurality of openings and into the annular space between the wellbore tubing and the wellbore casing or wellbore liner.

13. The method of claim 12 wherein the repeated placing the barrier material has a barrier material volume such that a level of the barrier material displaced into the annular space between the wellbore tubing and the wellbore casing or wellbore liner is below a second one of the plurality of openings above the first exposed.

* * * * *